United States Patent [19]

Urriola

[11] Patent Number: 5,030,343

[45] Date of Patent: Jul. 9, 1991

[54] DRAINAGE CELL

[76] Inventor: Humberto Urriola, 55 Romney Rd., St. Ives, New South Wales, Australia

[21] Appl. No.: 36,005

[22] Filed: Apr. 8, 1987

[30] Foreign Application Priority Data

Apr. 9, 1986 [AU] Australia ..... PHO5382

[51] Int. Cl.[5] ..... E02B 11/00

[52] U.S. Cl. ..... 210/170; 210/293; 405/43; 405/45

[58] Field of Search ..... 52/249, 169.5; 405/43, 405/44, 45; 210/486, 170, 295

[56] References Cited

U.S. PATENT DOCUMENTS

| | | | |
|---|---|---|---|
| 1,601,465 | 9/1926 | Barbour | 210/193 X |
| 1,773,417 | 8/1930 | Whitacre | 210/150 |
| 2,378,239 | 6/1945 | Myron | 210/143 |
| 2,874,844 | 2/1959 | Wanner | 210/150 |
| 3,611,729 | 10/1971 | Stark | 405/43 X |
| 3,795,180 | 3/1974 | Larson | 94/33 |
| 4,057,550 | 11/1977 | Wagner | 210/170 |
| 4,246,305 | 1/1981 | Delattre | 405/43 X |
| 4,572,700 | 2/1986 | Mantarro et al. | 405/45 X |
| 4,619,765 | 10/1986 | Roberts | 210/289 |

*Primary Examiner*—Frank Spear

*Attorney, Agent, or Firm*—Bryan, Cave, McPheeters & McRoberts

[57] ABSTRACT

A rigid cell-like structure primarily for use under gardens and roads where it is required to provided good drainage; the cell comprising two substantially parallel perforate planar surfaces maintained in a fixed spaced relationship from each other by means of a plurality of spacer members; the perforate nature of both surfaces and the disposition of spacer members being such that gases or liquids may freely pass through the composite structure around the spacer means in any direction.

12 Claims, 2 Drawing Sheets

DRAINAGE CELL

Figure 1:
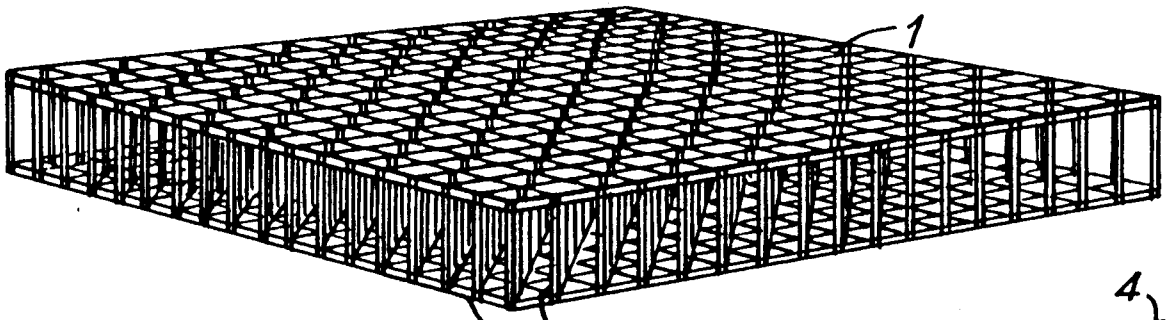

The present invention relates to the provision of adequate drainage by artificial means and has particular application in the area of landscape gardening.

Known methods of draining relatively large surface areas where the funnelling of water directly into narrow diameter pipes is impractical or impossible involve the use of a layer of stone or gravel capable of supporting the surface to be drained. Water from this "gravel" layer may then be allowed to percolate into the ground below, and to follow the lay of the land through said gravel to further conventional drainage channels or pipes or otherwise evacuated. In the case of a roof-top garden, for example, a concrete reof-top may be provided with a water impervious membrane opening into conventional channels, gutters or drains; a layer of pebbles may then be provided over such membrane followed by a filter membrane over such layer of pebbles over which filter membrane a layer of soil is laid in wich vegetation may be grown.

The filter membrane prevents the soil from clogging the layer of pebbles thereby preventing drainage; the layer of pebbles facilitates drainage of the soil and hence adequate oxygen for the roots of vegetation. The lower impervious membrane in turn prevents the ingress of moisture to the building or structure below.

Such a system as mentioned above involving pebbles, gravel or stone has been found to have various defects particularly in roof-top applications. The above-mentioned conventional system may be expensive insofar as stones or pebbles are heavy, thus presenting transportation problems to high or inaccessible locations. The weight also may dictate otherwise unnecessary reinforcement of the supporting structure. It has been further found that where a water-impervious membrane is employed below a layer of pebbles the pebbles often breach the water-tight integrity of such membrane due to sharp edges and/or excessive weight. The conventional system as mentioned above furthermore makes no provision for the deployment of conduits for water or power through the drainage area particularly where such conduits are to be laid after the drainage system is in existence. The present invention seeks to ameliorate one or more of the above-mentioned disadvantages with the prior art or at least provide the consumer with a choice.

According to the present invention there is provided a rigid cell structure comprising first and second parallel perforate planar members maintained in a fixed spaced relationship from each other by means of a plurality of spacer members of adequate strength to ensure that either one of the perforate planar surfaces has a load-bearing capability of at least twenty kilograms per square metre when the opposing perforate planar surface is supported by a rigid planar surface; the perforate nature of both surfaces and the disposition of spacer members being such that gases or liquids may freely pass through the cell structure around the spacer means in any direction.

The present invention also teaches a method of providing drainage utilising the above-mentioned apparatus. In addition to roof-top garden applications, it is envisaged that the invention may be of use to provide drainage under roadways, under embankments and elsewhere where surface erosion would otherwise be a problem. One example of an article in accordance with the present invention will now be described with reference to the accompanying drawings wherein:

FIG. I is a partial perspective view of a cell in accordance with the present invention;

FIG. II is a further partial perspective view of the cell of FIG. I;

FIG. III is a side elevation of the cell depicted in FIGS. I and II.

FIG. I depicts a drainage cell comprising a first planar perforate surface 1 and a second planar perforate surface 2 maintained in parallel spaced relationship to each other by a plurality of upright spacer members 3.

Figure 2:
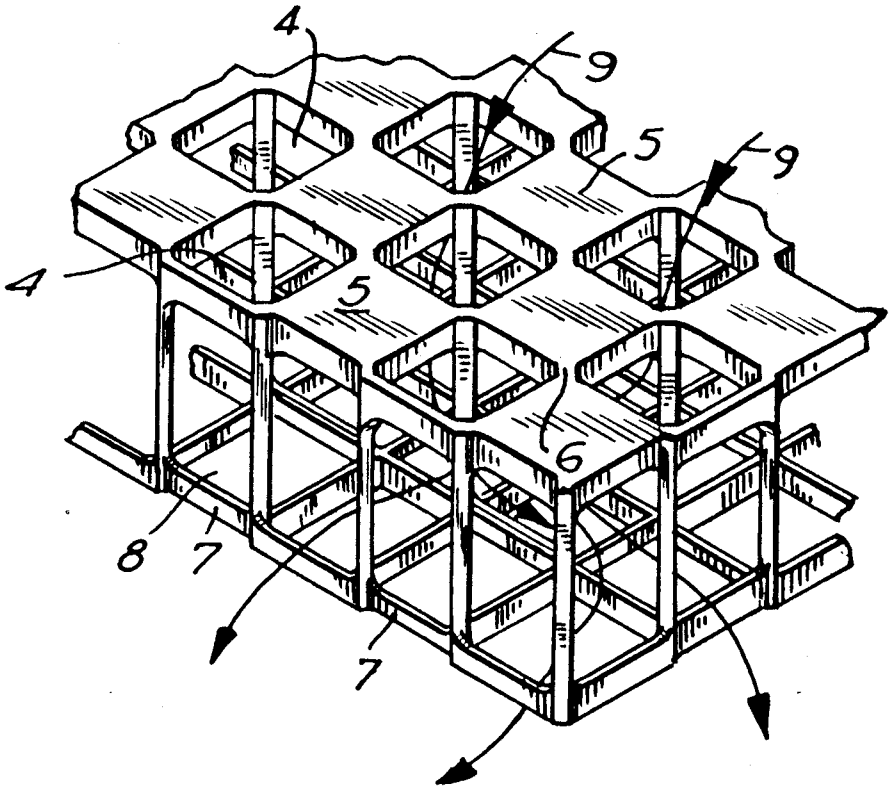
Figure 3:
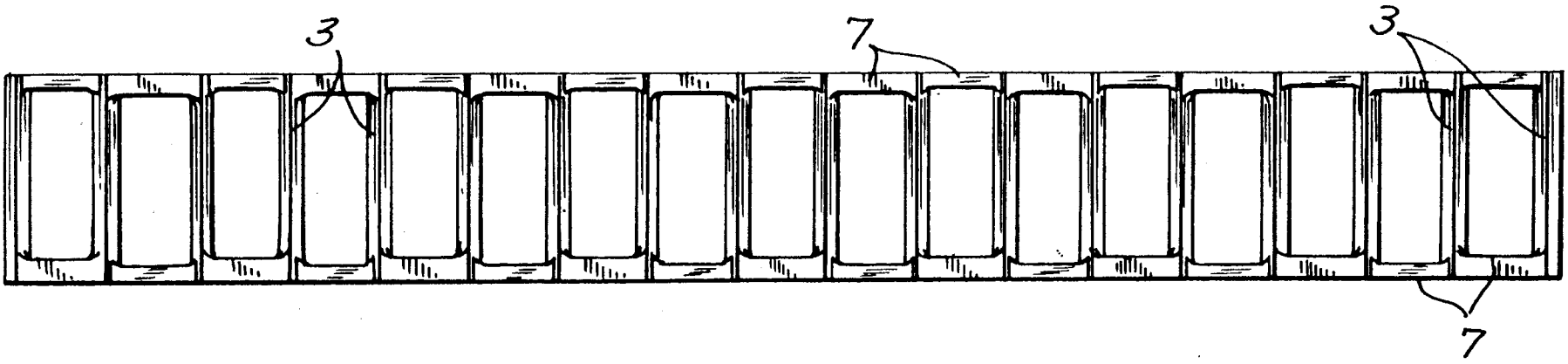

The nature of perforations in the embodiment of FIGS. I and II may best by observed from FIG. 2 which clearly depicts substantially square perforate areas 4 in the first planar surface 1. It will be noted that the square perforate areas are interposed with substantially square load-bearing sections 5 such that the resulting configuration of the first planar surface 1 is checkered. In this embodiment the second perforate planar surface is of the same configuration as the first perforate planar surface except that the square perforate sections are out of register with each other, such that directly beneath each square perforate section of the first perforate planar surface lies a square load-bearing section of the second planar perforate surface.

It will be appreciated that a configuration as above described result in planar surfaces having approximately fifty per cent of their surface area devoted to perforations and the remaining fifty per cent devoted to a surface which is capable of load bearing. In, say, a roof-top application where a membrane may be employed above the cell adjacent to the first perforate planar surface and possibly additionally beneath the cell it is important that the load-bearing surfaces comprise a significant proportion of the planar surfaces in order that loads may be distributed. If this were not the case then the cell might perforate adjacent membranes thereby destroying their effectiveness. Where the cell is laid directly, for example, on a bitumenised roof (not shown), this feature is particularly important as it would not be appropriate for the spacer members 3 to bear directly on the bitumenised surface thereby allowing perforation of the bitumenised surface when a load was applied to the upper surface of the cell It will be appreciated that the spacer members 3 are rectangular in configuration and are (when viewed in transverse section) are oriented diagonally of the square pattern associated with the planar surfaces so that the ends of such spacer members 6 form bridges between adjacent load bearing surfaces thereby tying in adjacent load bearing surfaces to each other and ensuring a coherent rigid structure.

Some bracing of the spacer members 3 is achieved by low upstanding walls 7 inwardly directed from the planar perforate surfaces running between adjacent spacer members and extending along the edges defining the square load bearing surfaces.

It will be noted that these small upstanding walls 7 define shallow areas 8 which are capable of holding small amounts of pooled liquid. This is an important feature where the cell is used for drainage of, say, a roof-top garden as during periods where no water flow is present the water in such areas may evaporate, thereby assisting to maintain the roots of any plants or grass above the drainage cell in a moist condition conducive to plant life.

While it is envisaged that the primary function of the drainage cell will be to accept water through its first and upper perforate planar surface and to allow free percolation of the water through the cell towards a drain (not shown) beneath the cell it should be appreciated that the cell additionally assists in maintaining oxygen adjacent the roots of any plants above the upper planar surface. It should be noted that the nature of the spacer members permits free flow of water and oxygen in any horizontal direction within the cell and therefore it is usually not necessary to orient the cell in any particular direction with respect to the fall of the surface over which it is installed. The relatively open nature of the area between the two planar surfaces additionally may provide space through which conduits may be passed for various services which may be associated with a building.

Line 9 depict the possible directions for flow of water entering the upper surface of the cell and flowing through the cell. The cell may advantageously be fabricated from one of a number of plastic materials in a unitary configuration and in this regard polypropylene has been found to be appropriate.

The multiplicity of spacer members 3 together with walls 7 results in a relatively rigid structure which is capable of supporting substantial loads and, for example, where the spacer members are approximately thirty millimetres in length and three millimetres by three millimetres in cross-section, the load bearing capabilities of the upper planar surface where the lower planar surface is supported on a concrete slab is approximately 38,000 kilograms per square metre.

The embodiment of FIG. I is approximately three hundred millimetres by three hundred millimetres square and in order to cover a large surface a number of drainage cells may be laid beside each other.

It should be appreciated that the present invention provides a light drainage cell which permits large volumes of water to be drained beneath a variety of surfaces and may furthermore enhance growth of vegetation above the cell.

Although it is not depicted herein those skilled in the art of drainage will note that a filter membrane should be utilised above a cell in accordance with the present invention due to the large apertures in the upper perforate planar surface and in this regard "terraferma" brand polyester membranes are appropriate.

From FIG. II it may be observed that the edges of the drainage cell are not pefectly straight but comprises a series of tongues 10 and grooves 11. These tongues and grooves in the edges of one cell member facilitate a fairly precise location of adjacent cells where cells are placed side by side so as to form a large mat. This is due to the fact that the tongue 10 of one cell will fit into the grooves 11 of an adjacent cell thereby preventing relative horizontal movement between adjacent cells provided they are urged towards each other. The claims defining the invention are as follows:

I claim:

1. A drainage cell permitting the drainage of large volumes of liquids from adjacent layers supported thereon, which comprises a rigid, unitary structure incorporating:

(a) first and second substantially parallel, load-bearing surfaces for supporting layers requiring drainage, said surface comprising individual perforate portions having substantially equal areas which, in the aggregate, comprise at least 40% of the total area of said surfaces; and (b) a plurality of rigid spacer members maintaining said surfaces in fixed, spaced relation relative to one another;

the perforate nature of said surfaces and the disposition of the spacer members being such that either one of the perforate planar surfaces has a load bearing capacity of at least 20 $kg/m^2$ when the opposing perforate planar surface is supported by a rigid planar surface, and gases or liquids may freely pass through the composite structure around the spacer members in any direction.

2. A structure in accordance with claim 1 wherein the perforate areas are formed as parallelograms interposed with load bearing sections of like configuration and dimensions in a checkered configuration; the spacer members being joined to the perforate planar members adjacent the corners of such parallelogram shaped load bearing sections and perforate areas.

3. A structure in accordance with claim 1 wherein all perforate areas of one perforate surface are out of register with the perforate areas of the opposing perforate surface.

4. A structure in accordance with any claim 1 where at least one of the planar perforate surfaces includes upon its internally facing side a plurality of low upstanding walls extendings between adjacent spacer members defining shallow areas adapted to trap small quantities of liquid.

5. A structure in accordance with claim 1 wherein the cell structure is of adequate strength to ensure that either one of the perforate planar surfaces has a load bearing capacity of at least twenty kilograms per square metre when the opposing perforate planar surface is supported by a rigid planar surface.

6. A structure in accordance with claim 1 wherein the cell structure is of adequate strength to ensure that either one of the perforate planar surfaces has a load bearing capability of up to 90,000 kilograms per square meter when the opposing perforate planar surface is supported by a rigid planar surface.

7. A rigid cell structure in accordance with claim 1 wherein there is a regular pattern of shallow tongues and grooves along the peripheral edges of the element to allow the elements to be interlocked when asembled into a mat.

8. A structure in accordance with claim 1 wherein the perforate areas are of a substantially square configuration interposed with substantially square load-bearing sections of similar dimensions in a checkered configuration; the spacer members being joined to the perforate planar members adjacent the corners of such square sections to form bridges between the adjacent load-bearing sections and thereby ensure a coherent rigid structure.

9. A structure in accordance with claim 1 wherein the spacer members are columnar in configuration and disposed substantially normally to the two parallel perforate surfaces.

10. A structure in accordance with claim 1 wherein the perforate areas are formed as parallelograms interposed with load-bearing sections of like configuration and dimensions in a checkered configuration; the spacer members being joined to the perforated planar members adjacent the corners of such parallelogram shaped load-bearing sections and perforate areas.

11. A structure in accordance with claim 1, futher including a plurality of bracing walls on at least one of said load-bearing surfaces and extending between adjacent space members.

12. A structure in accordance with claim 1 wherein the perforations in the load bearing surfaces are offset from one another and the spacer members are joined to the surfaces adjacent the edges of the perforations in order that gases or liquids may freely pass through the composite structure around the spacer members in any direction.

* * * * *

UNITED STATES PATENT AND TRADEMARK OFFICE

CERTIFICATE OF CORRECTION

PATENT NO. : 5,030,343

DATED : July 9, 1991

INVENTOR(S) : Humberto Urriola

It is certified that error appears in the above-identified patent and that said Letters Patent is hereby corrected as shown below:

Column 1, line 16: Change "reof-top" to --roof-top--.
Column 2, line 28: Change "result" to --results--.
Column 2, line 49: Delete "are"; change "of" to --to--.
Column 3, line 5: Insert --,-- after "cell.".

Column 4, line 28: Change "extendings" to --extending--.
Column 4, line 65: Change "perforated" to --perforate--.

Signed and Sealed this

Thirteenth Day of April, 1993

*Attest:*

STEPHEN G. KUNIN

*Attesting Officer*

*Acting Commissioner of Patents and Trademarks*